US007406964B2

(12) United States Patent
Diaz

(10) Patent No.: US 7,406,964 B2
(45) Date of Patent: Aug. 5, 2008

(54) SCUBA WALK IMPROVED UNDERWATER BREATHING APPARATUS

(76) Inventor: Vincent P. Diaz, P.O. Box 1369, Agana, GU (US) 96932

( * ) Notice: Subject to any disclaimer, the term of this patent is extended or adjusted under 35 U.S.C. 154(b) by 511 days.

(21) Appl. No.: 11/222,990

(22) Filed: Sep. 8, 2005

(65) Prior Publication Data

US 2007/0051365 A1 Mar. 8, 2007

(51) Int. Cl.
*B63C 11/02* (2006.01)

(52) U.S. Cl. ..... 128/205.22; 128/201.27; 128/200.29

(58) Field of Classification Search ..... 128/201.22, 128/201.27, 201.28, 201.29, 205.22, 200.29; 2/2.15

See application file for complete search history.

(56) References Cited

U.S. PATENT DOCUMENTS 3,675,650 A * 7/1972 Domyan et al. ..... 128/201.27
3,880,157 A * 4/1975 Elifritz ..... 128/201.27
5,079,775 A * 1/1992 Kaburaki ..... 128/200.29
5,620,282 A * 4/1997 Stinton ..... 405/186
5,887,836 A * 3/1999 Back ..... 248/221.11
5,906,200 A * 5/1999 Kaburaki ..... 128/201.27
6,293,733 B1 * 9/2001 Tezuka ..... 405/185

* cited by examiner

*Primary Examiner*—Steven O Douglas
(74) *Attorney, Agent, or Firm*—Timothy M. Barlow

(57) ABSTRACT

An improved underwater breathing apparatus includes a gas- and liquid-tight helmet, with an attached air valve, tank coupling and tank bracket. The helmet further includes a flange generally conforming to the shoulders of a user, and incorporates ballast material. The air valve is attached to the helmet with the tank coupling and the tank bracket is attached to the tank coupling. When worn, the tank bracket is oriented substantially parallel to, and a finite distance away from, the user, whereby only the flange contacts the user. In other embodiments the helmet further includes an optically transparent face shield, or the entire helmet is may be manufactured from an optically transparent material. A handle may be attached to the helmet to aid in lifting and storage. The air valve may include an air flow regulator, a compressed air supply coupling or an air flow gauge.

20 Claims, 3 Drawing Sheets

SCUBA WALK IMPROVED UNDERWATER BREATHING APPARATUS

BACKGROUND OF THE INVENTION

1. Field of the Invention

The present invention relates to underwater breathing systems, and more specifically to an easy-to-use, underwater breathing and viewing system.

2. Description of the Related Art

SCUBA equipment has been around for decades. Most of the devices are similar. They include a compressed air tank with a harness to be worn by a diver. An air pressure regulator, air pressure gauge, and mouthpiece control the air to the diver. A mask is worn to protect the diver's eyes. The equipment is not terribly complex, but it requires a significant amount of training to use safely and properly. Not only must the diver learn to breathe primarily through the mouth, he must also know how to deal with equipment malfunctions and emergencies automatically. Those automatic emergency responses are developed through hours of repetitive practice in a controlled environment. There are common variations on the basic equipment, such as a mouthpiece combined with a face mask, but these modifications do not necessarily make it easier to use and, thus do not take the place of the appropriate emergency responses.

It is undisputed that a large number of people who do not know how to dive with SCUBA gear would like to learn. The time investment required to receive proper training is probably the biggest impediment to more people enjoying the underwater world. This situation is quite evident at popular diving areas, where the attraction of the underwater world is greatest. Novices decide they want to experience the joys of diving. Thus, they need to learn to dive right away. For most of these people, however, it just isn't possible to complete the required training in the limited time they have available. The equipment is too complex and mistakes are too costly.

Therefore, there has been and continues to be a need for an underwater breathing apparatus that is very easy to don and use, and that has a minimum of equipment to manipulate and adjust, so that even complete novices can safely experience the joys known to SCUBA divers.

SUMMARY OF THE DISCLOSURE

The device is an improved underwater breathing apparatus having a helmet to be worn over a user's head. The helmet is open at the bottom, thereby keeping air inside and water out. The lower edge, or flange, of the helmet conforms generally to the shoulders of the user, and the lower edge includes ballast material to give the device negative buoyancy so that no straps or harness system are required to hold the helmet onto the diver's head, and the diver will sink without effort. A tank coupling is attached to the helmet along with an airflow valve, which is adjusted to provide sufficient air for the depth of the dive. A tank bracket is removably attached to the tank coupling. The tank bracket is oriented substantially parallel to, and a finite distance away from the user, to hold the compressed air tank and the bracket away from the user. Only the lower edge of the helmet flange contacts the user.

Accordingly, it is a principal object of the invention to disclose an improved underwater breathing apparatus that requires very little training to use safely.

It is another object of the invention to teach an improved underwater breathing apparatus that requires no harness or straps to attach a user to the device.

It is a further object of the invention to disclose an improved underwater breathing apparatus that rests solely upon the shoulders of the user and provides enough ballast to permit the user to walk on the ocean floor.

It is another object of the invention to teach an improved underwater breathing apparatus that includes an air valve with a graduated air flow regulator that can be set to the airflow needs for a preselected depth.

It is an object of the invention to provide improved elements and arrangements thereof for the purposes described which is inexpensive, dependable and fully effective in accomplishing its intended purposes.

It is an object of the present invention to accomplish the foregoing objectives in a simple and cost effective manner.

These and other objects of the present invention will become readily apparent upon further review of the following specification and drawings.

DETAILED DESCRIPTION OF THE PREFERRED EMBODIMENT

The following detailed description is of the best presently contemplated modes of carrying out the invention. This description is not to be taken in a limiting sense, but is made merely for the purpose of illustrating general principles of embodiments of the invention.

The present invention provides an improved underwater breathing apparatus that is easy to use, requires no special training, and requires no straps or harness for the diver.

Figure 1:
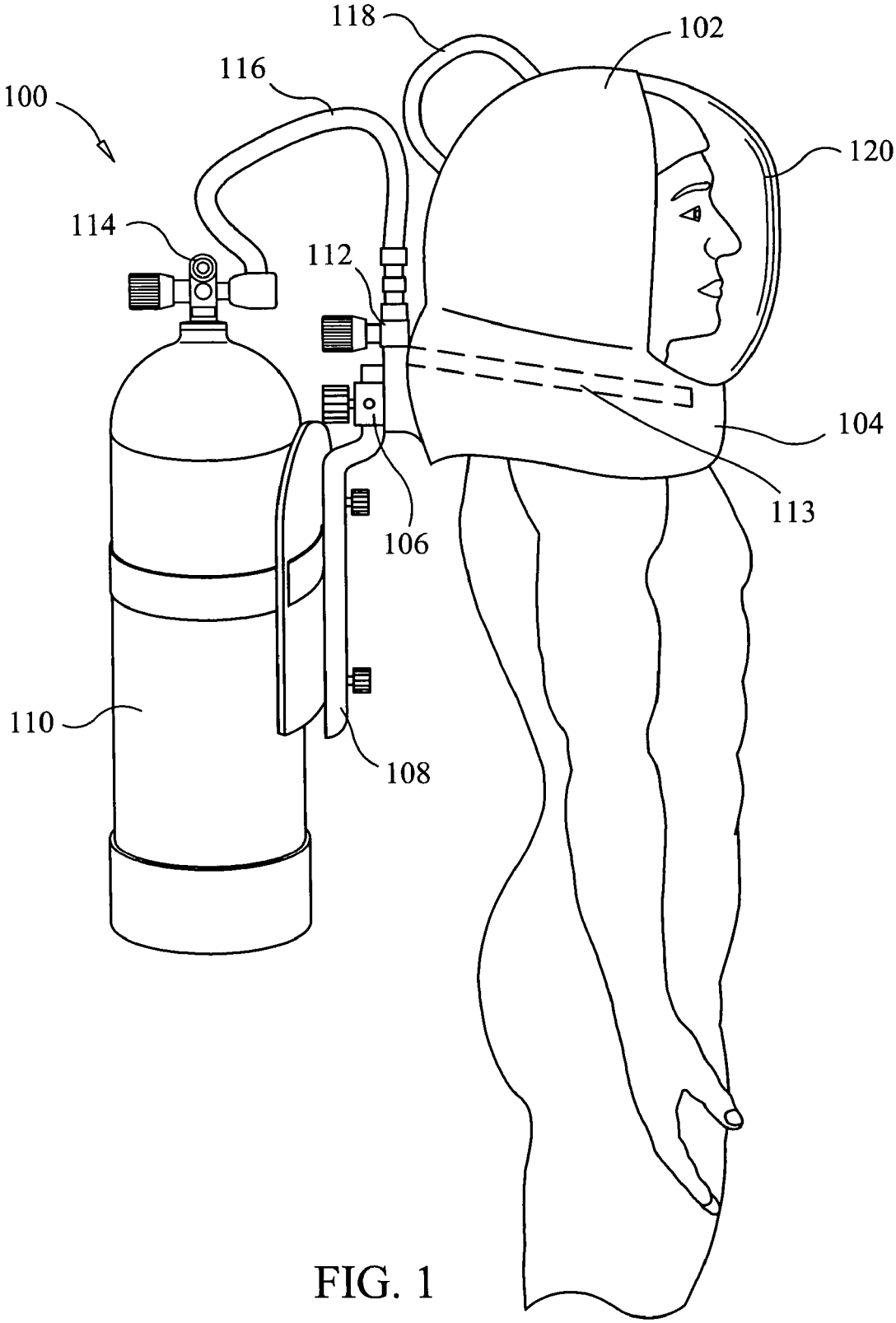
FIG. 1 is an environmental view of an improved underwater breathing apparatus, in accordance with the present invention.

FIG. 1 shows an environmental view of an improved underwater breathing apparatus 100. The underwater breathing apparatus 100 shown includes a helmet 102 that is both watertight and air tight. While the helmet 102 is upright, air inside the helmet 102 cannot leak out through the top of the helmet 102. The lower part of the helmet 102 includes a flange 104 which is a generally annular region of the helmet 102 to contact and rest upon the diver's shoulders. This is the only contact between the diver and the improved underwater breathing apparatus 100.

The flange 104 contains enough ballast to provide negative buoyancy to a diver. That is, the diver will sink. The underwater breathing apparatus 100 may be made in different sizes and weights to provide just enough ballast to each diver, without being excessively heavy. 65 to 85 pounds of ballast is appropriate for most divers, although it could be made with greater or lesser amounts of ballast to suit the needs of smaller or larger divers.

A tank coupling 106 is attached to the back of the helmet 102 and provides an attachment point for a tank bracket 108, which carries a compressed air tank 110. An air valve 112 is attached to the helmet 102 and provides adjustability of the airflow through the helmet 102 via air delivery lines 113. The air delivery lines 113 are routed so as to be above the water level in the helmet 102, to minimize or eliminate splashing and bubbles within the helmet 102. A number of air exit ports 115 are located on the back of the helmet 102, near the tank coupling 106. The air exit ports 115 are located below the level of the exit in the air delivery lines 113 to keep the helmet 102 substantially full of air, for maximum comfort. An air pressure regulator 114 on the air tank 110 is attached to the air valve 112 via an air hose 116. A handle 118 may be provided on the helmet 102. The helmet 102 is shown with a clear face shield 120. The air exit ports 115 are on the back of the helmet 102 to keep bubbles away from the face shield 120. The location of the air exit ports 115 may be raised or lowered relative to the air delivery lines 113 to provide the optimum level of water in the helmet 102. In another embodiment, substantially the entire helmet 102 is made from an optically transparent material to provide a large field of vision.

Figure 2:
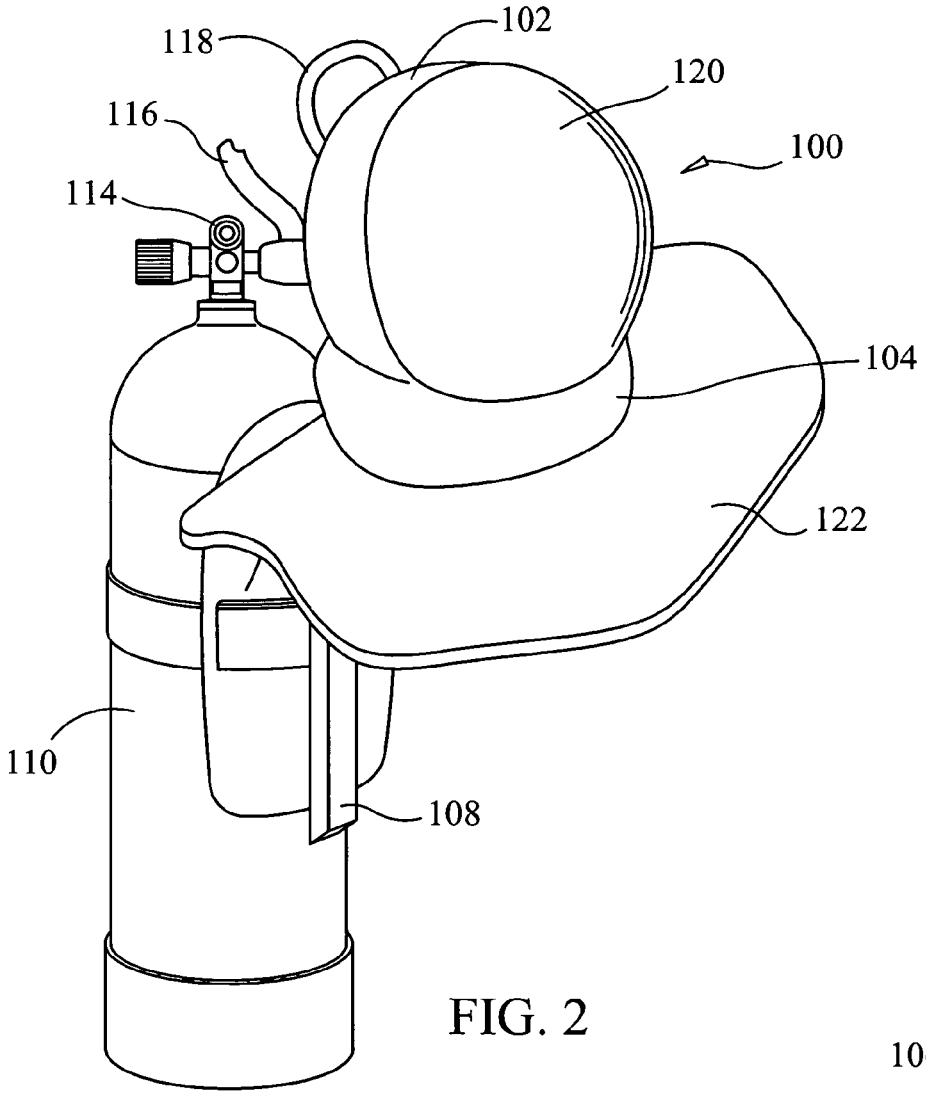
FIG. 2 is a perspective view of the improved underwater breathing apparatus, in accordance with the present invention.

FIG. 2 shows a perspective view of an alternative embodiment of the improved underwater breathing apparatus 100. In this embodiment, an apron 122 is attached to the bottom of the flange 104. The apron 122 distributes the weight of the breathing apparatus 100 across the diver's shoulders. This can be a significant load to bear when the diver is out of water, due to the amount of ballast required to provide negative buoyancy.

Figure 3:
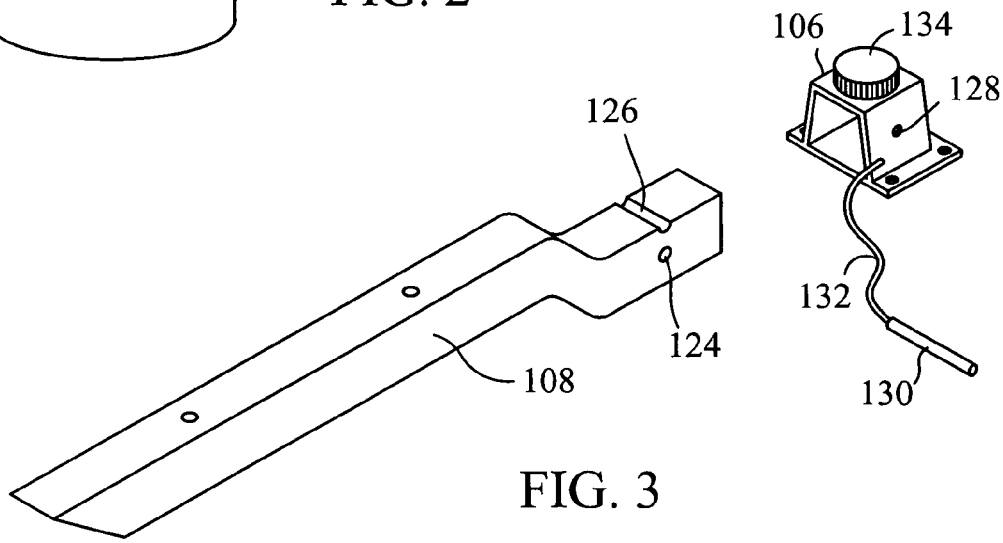
FIG. 3 is a perspective view of a tank coupling and tank bracket for the improved underwater breathing apparatus, in accordance with the present invention.

FIG. 3 shows a detailed view of the tank coupling 106 and tank bracket 108 for the improved underwater breathing apparatus 100. The tank bracket 108 supports the compressed air tank 110. An aperture 124 passes through the upper end of the tank bracket 108 and a locking groove 126 is on the dorsal side of the tank bracket 108. The aperture 124 and locking groove 126 are used with complementary features on the tank coupling 106.

A pair of tank coupling apertures 128 are arranged on the left and right sides of the tank coupling 106. When the upper end of the tank bracket 108 is placed into the tank coupling 106, the apertures 124, 128 will align so that a locking pin 130 may be inserted through all of the apertures 124, 128 simultaneously. The pin 130 is prevented from being misplaced with a cable 132 that attaches the pin 130 to the tank coupling 106. Once the pin 130 is holding the tank bracket 108 to the tank coupling 106 in the proper orientation, the tank bracket 108 and tank coupling 106 are held securely together with a thumbscrew 134 that is shown threaded into the tank coupling 106. The thumbscrew 134 engages the groove 126 in the tank bracket 108. The thumbscrew 134 includes a large wheel to make tightening and loosening easy, even when wet and slippery.

Figure 4:
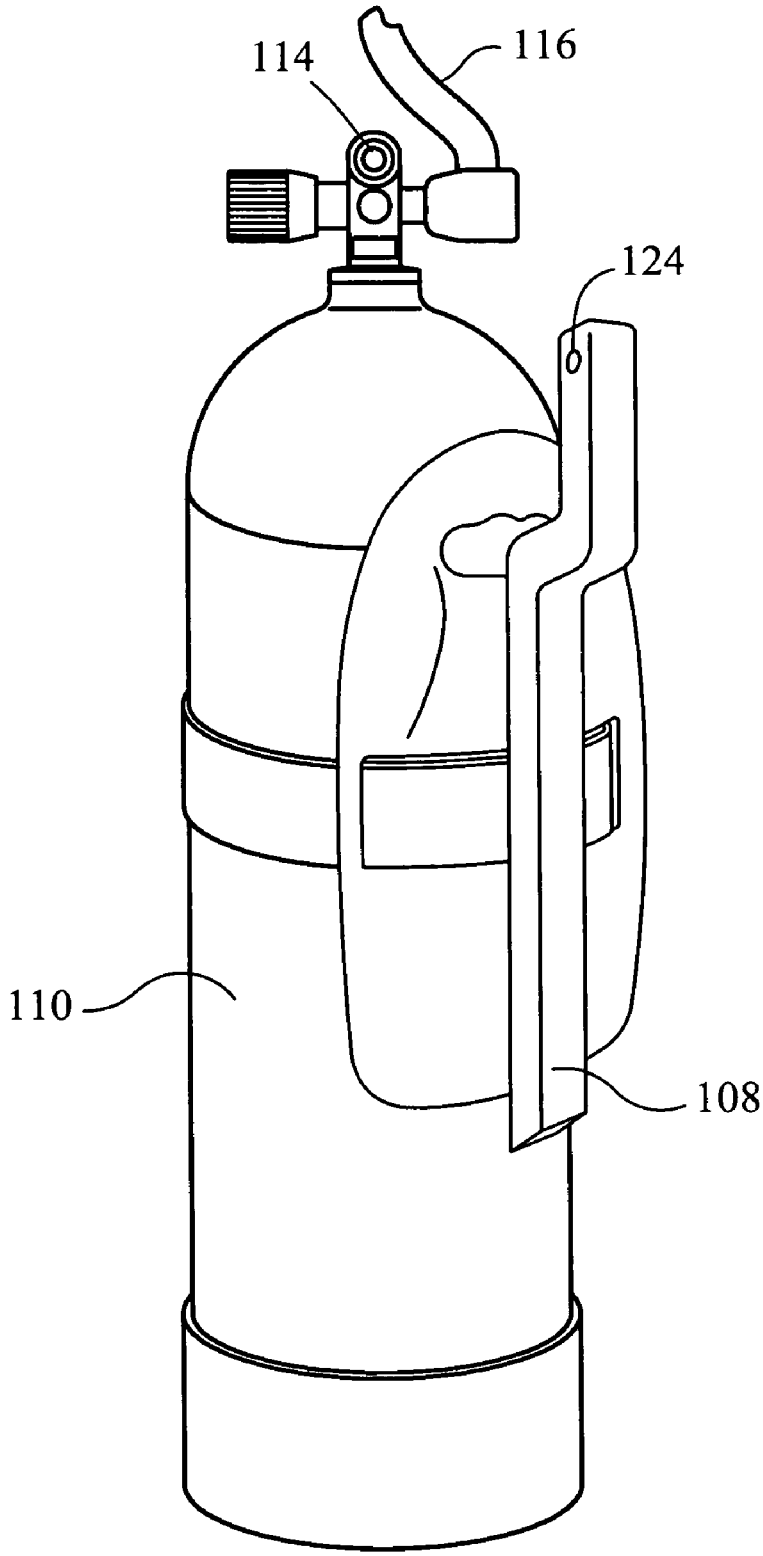
FIG. 4 is a perspective view of the tank bracket for the improved underwater breathing apparatus, in accordance with the present invention.

FIG. 4 shows a perspective view of the tank bracket 108 for the improved underwater breathing apparatus 100. The compressed air tank 110 is shown strapped to the tank bracket 108.

OPERATION

The quick and easy disassembly of the tank bracket 108 from the tank coupling 106 simplifies the task of the diver. The entire assembled underwater breathing apparatus can be quite heavy and unwieldy, especially if the diver is wearing the apparatus 100 out of the water. It would be preferable for most people to transport the apparatus 100 to the dive site in two pieces, with the tank bracket 108 and compressed air tank 110 separate from the helmet portion.

The handle 118 makes it relatively easy to carry the helmet 102. Once at the dive site, the diver would assemble the apparatus 100, turn on the air pressure regulator 114 and air valve 112, place the entire assembled apparatus 100 over his head, and commence diving.

Alternatively, the diver would place the helmet 102 over his head so that an assistant can attach the tank bracket 108 into the tank coupling 106. The pin 130 is inserted through the apertures 124, 128, and the thumbscrew 134 is tightened into the groove 126. Next, the air pressure regulator 114 is turned on and the air valve 112 is adjusted to the setting that is appropriate for the diving depth.

In one embodiment, the air valve 112 is graduated with depth information so that it can be adjusted to supply the correct amount of air for the maximum diving depth. A greater flow of air would be needed for deeper dives, and a lesser amount of airflow for shallower dives. The graduated air valve 112 eliminates the guesswork in selecting the proper airflow. The helmet 102 is kept filled with air when the airflow valve is set properly. Thus, the diver, even if inexperienced, will be able to breathe and dive in comfort. As excess air is produced, from breathing and the flow from the air valve 112, the excess air will spill out from the lower edge of the helmet 102, beneath the flange 104, at the highest point. Alternatively, the excess air will escape through the air exit ports 115, if so equipped. Optimally, the excess air is released at the back of the flange 104 so that the bubbles do not interfere with the diver's view.

An air pressure gauge (not shown) may be provided, attached to the regulator 114, so that the diver can keep track of his air supply. An airflow gauge (not shown) may be attached to the air valve 112 to provide an alternative to the graduated air valve 112. Both the airflow gauge and the air pressure gauge may be attached to the air valve 112 or the regulator 114, respectively, with long hoses or cords to provide a ready source of information for the diver.

Divers may be delivered to the ocean floor via a ladder extending from a boat or a stationary floating platform. In this manner, the diver remains on his feet and keeps the improved underwater breathing apparatus substantially vertical, keeping the helmet 102 substantially full of air. This device is easy to use for novices and experts alike. Underwater tour guides and dive operators could provide this device for their clients, using a small staff of assistants for customer supports both in and out of water.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A self contained underwater breathing apparatus, comprising:

a gas- and liquid-tight helmet, comprising a shoulder flange adapted to generally conform to the shoulders of a user, where the flange includes ballast material;

an air valve attached to the helmet;

a tank coupling attached to the helmet; and a tank bracket attached to the tank coupling, where the tank bracket is oriented substantially vertically, parallel to, and a finite distance away from the user, whereby only the flange is adapted to contact the user.

2. The underwater breathing apparatus of claim 1, where the helmet further comprises an optically transparent face shield.

3. The underwater breathing apparatus of claim 1, where the entire helmet is made is an optically transparent material.

4. The underwater breathing apparatus of claim 1, further comprising a handle attached to the helmet.

5. The underwater breathing apparatus of claim 1, where the air valve comprises an air flow regulator.

6. The underwater breathing apparatus of claim 1, where the air valve comprises a compressed air supply coupling.

7. The underwater breathing apparatus of claim 1, where the air valve further comprises an air flow gauge.

8. A self-contained underwater breathing apparatus, comprising:

a gas- and liquid-tight helmet, comprising a shoulder flange adapted to generally conform to the shoulders of a user, where the flange includes ballast material, and further comprising an optically transparent face shield;

an air valve attached to the helmet;

a tank coupling attached to the helmet; and a tank bracket attached to the tank coupling, where the tank bracket is oriented substantially vertically, parallel to, and a finite distance away from the user, whereby only the flange is adapted to contact the user.

9. The underwater breathing apparatus of claim 8, where the entire helmet is made from an optically transparent material.

10. The underwater breathing apparatus of claim 8, where the helmet further comprises a handle.

11. The underwater breathing apparatus of claim 8, where the air valve comprises an air flow regulator.

12. The underwater breathing apparatus claim 8, further comprising at least one air delivery line connected to the air valve and routing through the helmet to provide air near the face shield.

13. The underwater breathing apparatus of claim 8, further comprising at least one air exit port, incorporated into the rear of the helmet at a level low enough to keep the user's head above water within the helmet.

14. The underwater breathing apparatus of claim 8, further comprising a compressed air tank removably attached to the tank bracket.

15. The underwater breathing apparatus of claim 14, further comprising an air pressure regulator attached to the compressed air tank and to the air valve via an air hose.

16. The underwater breathing apparatus of claim 14, further comprising an air pressure gauge attached to the compressed air tank.

17. A self-contained underwater breathing apparatus, comprising:

a gas- and liquid-tight helmet, comprising a shoulder flange adapted to generally conform to the shoulders of a user, where the flange includes ballast material, the helmet further comprising an optically transparent face shield and a handle;

an air valve attached to the helmet, the valve comprising an airflow regulator, a compressed air supply coupling and an airflow gauge;

a tank coupling attached to the helmet; and a tank bracket attached to the tank coupling, where the tank bracket is oriented substantially vertically, parallel to, and a finite distance away from the user, whereby only the flange is adapted to contact the user.

18. The underwater breathing apparatus of claim 17, where the helmet is made from an optically transparent material.

19. The underwater breathing apparatus of claim 17, further comprising a standard compressed air tank attached to the tank bracket.

20. The underwater breathing apparatus of claim 19, further comprising an air pressure regulator attached to the compressed air tank, and an air pressure gauge attached to the compressed air tank and further attached to the compressed air supply coupling via an air hose.

* * * * *